US011089407B2

(12) United States Patent
Shymanovych et al.

(10) Patent No.: US 11,089,407 B2
(45) Date of Patent: Aug. 10, 2021

(54) ELECTROACOUSTIC TRANSDUCER FOR HEADPHONES

(71) Applicant: RINARO ISODYNAMICS (EU) SP. Z O.O., Rzeszów (PL)

(72) Inventors: Pavlo Olegovych Shymanovych, Lviv (UA); Kostyantyn Kostyantynovych Baklayev, Lviv (UA); Eduard Olexiyovych Olexandrov, Lviv (UA)

(73) Assignee: RINARO ISODYNAMICS (EU) SP. Z O.O., Rzeszów (PL)

( * ) Notice: Subject to any disclaimer, the term of this patent is extended or adjusted under 35 U.S.C. 154(b) by 0 days.

(21) Appl. No.: 16/970,263

(22) PCT Filed: Jan. 28, 2019

(86) PCT No.: PCT/UA2019/000016
§ 371 (c)(1),
(2) Date: Aug. 14, 2020

(87) PCT Pub. No.: WO2019/160523
PCT Pub. Date: Aug. 22, 2019

(65) Prior Publication Data

US 2021/0160619 A1 May 27, 2021

(30) Foreign Application Priority Data

Feb. 16, 2018 (UA) ..... a 2018 01574

(51) Int. Cl.
*H04R 25/00* (2006.01)
*H04R 9/04* (2006.01)
(Continued)

(52) U.S. Cl.
CPC ..... *H04R 9/047* (2013.01); *H04R 1/1008* (2013.01); *H04R 7/04* (2013.01); *H04R 7/16* (2013.01); *H04R 9/025* (2013.01)

(58) Field of Classification Search
None
See application file for complete search history.

(56) References Cited

U.S. PATENT DOCUMENTS 3,922,503 A 11/1975 Tabuchi
2015/0326974 A1 11/2015 Skubinski, III et al.

FOREIGN PATENT DOCUMENTS

CN 209419783 U * 9/2019
DE 32 27 185 A1 2/1983
(Continued)

OTHER PUBLICATIONS

International Search Report in International Application No. PCT/UA2019/000016, filed Jan. 28, 2019.
(Continued)

*Primary Examiner* — Phylesha Dabney
(74) *Attorney, Agent, or Firm* — Saliwanchik, Lloyd & Eisenschenk

(57) ABSTRACT

The invention relates to electroacoustic transducers of electrodynamic type intended for the use in headphones. More particularly, the invention relates to the type of electroacoustic electrodynamic transducers having a vibration membrane with the voice coil with conductors fixed thereon and located in a constant magnetic field of the magnetic system of the electroacoustic transducer. The electroacoustic transducer for headphones comprises a dielectric membrane with a flat voice coil, a flat magnetic system comprising magnetized closed magnets axially spaced in concentric relationship, mounted on at least one side of the membrane configured so that the magnetic field can interact with the voice coil, according to the invention, the magnetic system further comprises at least two arc-shaped magnets located above the closed magnets and curved in the direction opposite to the closed magnets, and the voice coil comprises at least one part, which is located in the area of closed magnets and
(Continued)

follows the shape of closed magnets, and the second part, which is located in the area of arc-shaped magnets and is meander-shaped. The use of the combined magnetic system comprising closed, preferably ring-shaped, magnets located in the area of the ear canal of the human ear auricle and arc-shaped magnets located above the closed magnets and curved in the direction opposite to the closed magnets, with a certain ratio of pole areas, as well as the use of the respective topology of the voice coil with the part that follows the shape of closed magnets and the meander-shaped part located in the area of arc-shaped magnets allows to achieve improvement in qualities of electroacoustic transduction by expanding the range of reproducible frequencies and increasing the efficiency of the transducer while minimizing the internal volume of the earpieces of headphones.

10 Claims, 19 Drawing Sheets

(51) Int. Cl.

| | |
|---|---|
| ***H04R 7/04*** | (2006.01) |
| ***H04R 9/02*** | (2006.01) |
| ***H04R 1/10*** | (2006.01) |
| ***H04R 7/16*** | (2006.01) |

(56) References Cited

FOREIGN PATENT DOCUMENTS

| | | | | |
|---|---|---|---|---|
| GB | 1418360 | A | 12/1975 | |
| JP | 2009-147712 | A | 7/2009 | |
| WO | WO-02074009 | A1 * | 9/2002 | ..... H04R 9/047 |
| WO | WO-2019160523 | A1 * | 8/2019 | ..... H04R 9/047 |

OTHER PUBLICATIONS

Meander, Webpage <https://en.wikipedia.org/wiki/Meander>, Mar. 16, 2018, retrieved from Internet Archive Wayback Machine <https://web.archive.org/web/20180316191944/https://en.wikipedia.org/wiki/Meander> on Aug. 26, 2020, 22 pages.

LCD-3, Webpage <https://www.audeze.com/products/lcd-3>, Apr. 28, 2020, retrieved from Internet Archive Wayback Machine <https://web.archive.org/web/20200428074339/https://www.audeze.com/products/lcd-3> on Aug. 26, 2020, 10 pages.

What are Orthodynamic headphones?—Hifiheadphones, Webpage <https://www.hifiheadphones.co.uk/blogs/blog/what-are-orthodynamic-headphones>, Dec. 4, 2013, 5 pages.

OPPO PM-3 Closed-Back Planar Magnetic Headphones, Webpage <https://oppodigital.atazurewebsites.net/headphones-pm-3/headphones-PM-3-Features.aspx>, Nov. 25, 2016, retrieved from Internet Archive Wayback Machine <https://web.archive.org/web/20161125112050/https://oppodigital.azurewebsites.net/headphones-pm-3/headphones-PM-3-Features.aspx> on Aug. 26, 2020, 6 pages.

HE1000 V2, Webpage <https://hifiman.com/products/detail/267>, Sep. 27, 2016, retrieved from Internet Archive Wayback Machine <https://web.archive.org/web/20160927114601/https://hifiman.com/products/detail/267> on Aug. 26, 2020, 18 pages.

Headphone Measurements Explained—Frequency Response Part Two, Webpage <https://www.innerfidelity.com/content/headphone-measurements-explained-frequency-response-part-two>, Feb. 24, 2015, retrieved from Internet Archive Wayback Machine https://web.archive.org/web/20150224180147/https://www.innerfidelity.com/content/headphone-measurements-explained-frequency-response-part-two on Aug. 26, 2020, 13 pages.

* cited by examiner

S = 1554.3 мм $^2$

S = 1434.08 мм $^2$

S = 1455.88 мм $^2$

Table 1

| Variants of magnetic system | Area of magnets | | Ratio of the area of the closed magnets to the arc-shaped, % | Sound pressure level at frequencies, dB | | | | | | | | Comments |
|---|---|---|---|---|---|---|---|---|---|---|---|---|
| | | | | 50 Hz | | 400 Hz | | 3 kHz | | 10 kHz | | |
| | arc-shaped, mm² | closed (ring-shaped), mm² | | parts of the driver with closed magnets | parts of the driver with arc-shaped magnets | parts of the driver with closed magnets | parts of the driver with arc-shaped magnets | parts of the driver with closed magnets | parts of the driver with arc-shaped magnets | parts of the driver with closed magnets | parts of the driver with arc-shaped magnets | |
| 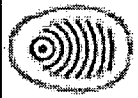 | 1075 | 225 | 21 | 78.2 | 97.5 | 92.4 | 97.1 | 95.0 | 95.3 | 88.3 | 83.2 | the total FR has a failure at mid-frequencies |
| 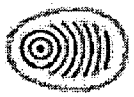 | 920 | 536 | 58 | 79.2 | 92.6 | 92.9 | 92.7 | 101.7 | 88.5 | 87.1 | 82.0 | the balanced FR |
| 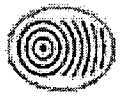 | 980 | 748 | 76 | 85.3 | 87.4 | 93.6 | 92.4 | 102.2 | 87.1 | 86.5 | 80.1 | the total FR has a failure at low frequencies |

Fig. 12

Table 2

| Numbers of points | Distance to the transducer, mm | | | | |
|---|---|---|---|---|---|
| | 4 | 8 | 12 | 16 | 20 |
|  | 101,0 | 101,5 | 99,0 | 97,8 | 96,5 |
| | 103,2 | 101,6 | 99,2 | 98,0 | 96,8 |
| | 103,3 | 101,7 | 99,4 | 98,3 | 97,3 |
| | 103,4 | 101,8 | 99,6 | 98,4 | 98,0 |
| | 103,4 | 102,0 | 99,7 | 98,9 | 98,6 |
| | 103,1 | 102,1 | 99,8 | 99,8 | 99,5 |
| | 102,4 | 102,2 | 99,9 | 100,9 | 100,6 |
| | 102,1 | 102,5 | 100,3 | 102,2 | 101,9 |
| | 102,4 | 103,1 | 101,2 | 103,2 | 103,1 |
| | 103,0 | 103,8 | 102,3 | 104,0 | 104,6 |
| | 103,4 | 104,4 | 103,2 | 104,4 | 104,5 |
| | 103,4 | 104,8 | 104,1 | 104,6 | 104,9 |
| | 103,3 | 104,9 | 104,7 | 104,7 | 105,0 |
| | 103,3 | 104,8 | 105,0 | 104,7 | 105,0 |
| | 103,4 | 104,6 | 105,2 | 104,6 | 104,8 |
| | 103,3 | 104,5 | 105,1 | 104,2 | 104,3 |
| | 103,6 | 104,7 | 104,9 | 103,4 | 103,5 |
| | 104,3 | 105,0 | 104,5 | 102,7 | 102,5 |
| | 105,2 | 105,4 | 104,0 | 102,0 | 101,6 |
| | 106,0 | 105,4 | 102,6 | 101,4 | 100,8 |
| | 106,4 | 104,9 | 102,1 | 100,9 | 100,0 |
| | 106,0 | 104,0 | 101,5 | 100,3 | 99,2 |
| | 105,0 | 102,9 | 100,8 | 99,3 | 98,1 |
| | 103,7 | 101,6 | 99,6 | 98,1 | 96,9 |
| | 102,0 | 100,0 | 98,2 | 96,8 | 95,7 |

Table 3

| Numbers of points | Distance to the transducer, mm | | | | |
|---|---|---|---|---|---|
| | 4 | 8 | 12 | 16 | 20 |
| | 85,6 | 95,0 | 90,0 | 88,4 | 89,7 |
| | 89,8 | 95,2 | 90,0 | 89,9 | 91,2 |
| | 93,9 | 95,3 | 91,4 | 92,5 | 93,7 |
| | 95,3 | 95,5 | 93,8 | 95,0 | 95,6 |
| | 95,1 | 96,1 | 96,1 | 96,5 | 96,5 |
| | 94,3 | 96,6 | 97,9 | 97,2 | 96,5 |
| | 92,9 | 95,4 | 98,6 | 97,4 | 96,8 |
| | 89,1 | 92,5 | 97,8 | 97,4 | 97,6 |
| | 86,1 | 88,2 | 96,0 | 96,8 | 97,5 |
| | 88,2 | 85,8 | 94,0 | 95,4 | 95,9 |
| | 89,9 | 88,4 | 93,1 | 92,9 | 92,6 |
| | 91,1 | 91,4 | 93,9 | 90,6 | 89,0 |
| | 91,5 | 91,2 | 95,8 | 89,6 | 87,8 |
| | 89,9 | 87,8 | 95,8 | 89,4 | 90,3 |
| | 89,7 | 76,2 | 92,6 | 91,5 | 94,3 |
| | 88,6 | 76,6 | 88,0 | 93,6 | 96,5 |
| | 82,3 | 83,8 | 90,8 | 94,4 | 96,9 |
| | 81,6 | 91,8 | 93,5 | 94,2 | 96,2 |
| | 92,6 | 96,1 | 96,1 | 94,6 | 95,5 |
| | 94,8 | 96,8 | 97,5 | 94,5 | 95,2 |
| | 93,1 | 95,2 | 97,5 | 92,9 | 93,9 |
| | 91,9 | 92,7 | 95,8 | 89,4 | 91,0 |
| | 92,3 | 91,6 | 92,5 | 85,3 | 86,1 |
| | 90,4 | 90,8 | 89,6 | 84,6 | 81,2 |
| | 87,8 | 89,2 | 88,9 | 85,2 | 80,4 |

Table 4

| Numbers of points | Distance to the transducer, mm | | | | |
|---|---|---|---|---|---|
| | 4 | 8 | 12 | 16 | 20 |
| | 82,5 | 82,4 | 77,1 | 74,0 | 76,1 |
| | 82,8 | 82,5 | 77,6 | 74,6 | 77,1 |
| | 82,9 | 82,5 | 79,5 | 74,7 | 79,4 |
| | 82,8 | 82,4 | 80,3 | 77,0 | 81,8 |
| | 80,6 | 79,6 | 81,7 | 78,5 | 82,3 |
| | 75,4 | 77,3 | 79,4 | 78,0 | 80,4 |
| | 73,8 | 79,4 | 74,5 | 74,4 | 78,2 |
| | 75,7 | 81,8 | 76,8 | 65,4 | 75,5 |
| | 77,0 | 83,3 | 78,6 | 70,8 | 71,0 |
| | 72,5 | 80,9 | 81,2 | 77,5 | 73,6 |
| | 76,0 | 82,0 | 80,6 | 76,9 | 74,4 |
| | 79,0 | 84,3 | 80,4 | 68,1 | 75,7 |
| | 79,7 | **85,2** | 79,0 | 64,9 | 77,7 |
| | 76,2 | 82,0 | 80,0 | 75,8 | 76,6 |
| | 76,0 | 79,1 | 81,4 | 78,3 | 76,0 |
| | 79,5 | 82,9 | 80,6 | 74,8 | 72,8 |
| | 81,0 | 84,4 | 80,3 | 66,7 | 72,3 |
| | 78,4 | 80,0 | 77,1 | 75,4 | 77,2 |
| | 79,7 | 80,2 | 84,3 | 82,9 | 81,8 |
| | 80,2 | 83,7 | **85,4** | **84,8** | **84,7** |
| | 84,2 | 82,8 | 83,4 | 81,5 | 83,2 |
| | **85,2** | 82,9 | 82,0 | 76,6 | 77,7 |
| | 83,8 | 84,7 | 82,6 | 78,4 | 75,6 |
| | 82,1 | 83,0 | 82,5 | 78,7 | 78,9 |
| | 78,5 | 82,0 | 80,0 | 76,2 | 79,0 |

Table 5

| Numbers of points | Distance to the transducer, mm | | | | |
|---|---|---|---|---|---|
| | 4 | 8 | 12 | 16 | 20 |
| | 69,5 | 70,7 | 66,8 | 60,9 | 59,8 |
| | 69,0 | 71,7 | 67,9 | 65,5 | 64,7 |
| | 68,5 | 72,6 | 69,9 | 69,4 | 67,3 |
| | 68,5 | **73,2** | 72,8 | 67,7 | 65,1 |
| | 70,8 | 71,7 | 70,7 | 67,3 | 66,2 |
| | 64,4 | 63,5 | 71,8 | 69,2 | 63,5 |
| | 60,1 | 67,9 | 73,5 | 68,6 | 59,3 |
| | 68,1 | 72,2 | 71,4 | 69,6 | 64,1 |
| | 66,2 | 66,6 | 70,8 | 70,4 | 66,1 |
| | 71,4 | 62,6 | 68,9 | 70,0 | 66,5 |
| | 53,6 | 63,5 | 60,3 | 65,9 | 69,0 |
| | 66,1 | 63,8 | 67,6 | 69,9 | 67,0 |
| | 72,2 | 68,6 | 65,1 | 68,6 | 65,8 |
| | 68,6 | 70,1 | 64,2 | 57,1 | 65,7 |
| | 66,0 | 60,9 | 66,3 | 67,7 | 67,5 |
| | 65,4 | 67,8 | **74,3** | 71,6 | 66,3 |
| | **72,9** | 73,2 | 72,1 | 67,0 | 56,8 |
| | 72,6 | 73,4 | 65,4 | 55,2 | 65,5 |
| | 68,7 | 60,2 | 69,9 | 70,6 | 69,8 |
| | 66,6 | 69,3 | 73,5 | **73,8** | **73,9** |
| | 67,8 | 71,2 | 72,9 | 70,5 | 71,0 |
| | 70,6 | 69,5 | 72,1 | 68,9 | 63,6 |
| | 71,9 | 70,6 | 65,4 | 67,0 | 66,3 |
| | 72,6 | 69,7 | 67,0 | 64,1 | 63,6 |
| | 70,6 | 70,0 | 67,2 | 67,2 | 65,2 |

ELECTROACOUSTIC TRANSDUCER FOR HEADPHONES

CROSS-REFERENCE TO RELATED APPLICATIONS

This application is the U.S. national stage application of International Patent Application No. PCT/UA2019/000016, filed Jan. 28, 2019, which claims the benefit under 35 U.S.C. § 119 of Ukrainian Application No. a 2018 01574, filed Feb. 16, 2018, the disclosures of each of which are incorporated herein by reference in their entirety.

The invention relates to electroacoustic transducers of electrodynamic type intended for the use in headphones. More particularly, the invention relates to the type of electroacoustic electrodynamic transducers having a vibration membrane with the voice coil with conductors fixed thereon and located in a constant magnetic field of the magnetic system of the electroacoustic transducer (hereinafter referred to as the transducer).

Many similar transducers are known including the following transducers considered the closest prior art.

The prior art discloses isodynamic electroacoustic transducers with a membrane having various shape and various topology (pattern) of voice coil conductors. The topology of voice coil conductors is determined, in turn, by the shape of the magnetic system. For example, the prior art describes a transducer in which the topology of conductors of flat voice coils has the shape of meanders (zigzags) https://en.wikipedia.org/wiki/Meander fixed on a rectangular membrane. Magnetic systems are configured to form lines of magnetic bars, arranged parallel to each other, with alternation of polarity. Permanent magnets create a magnetic field perpendicular to the current flowing in the flat conductor of the voice coil. By interacting they create a force that affects the membrane perpendicular to its surface and makes it vibrating and provides electroacoustic transduction (Application JP2009147712A, published on Jul. 2, 2009). A similar scheme is also implemented for headphones, in particular, in the Audeze LCD-3 model (https://www.audeze.com/products/lcd-collection/lcd-3) or in HiFiMan HE-560 and HE-1000 models (http://hifiman.com/products/detail/267). The LCD-3 and the HE-560 headphones have a rectangular membrane, while the HE-1000 headphones have an oval shape tapered towards the bottom, i.e. line the shape of an egg.

The disadvantage of transducers of the type described above is that they use zigzag (meander-shaped) voice coils. This shape leads to the emergence of areas in voice coil transducers which extend beyond the magnetic field of the magnetic system and are not involved in electroacoustic transduction.

The prior art also describes transducers comprising a magnetic system having the shape of magnetic circular disks with alternating poles in the radial direction or coaxially positioned magnetic rings with alternation of polarity. The topology of voice coil conductors is configured to form a spiral with alternating direction. The membrane is of round or oval shape. Such transducers are used in Yamaha YH-100 and YH-1000 headphones (http://www.hifiheadphones-.co.uk/reviews/what-are-orthodynamic-headphones/) or Oppo PM-1 and PM-3 headphones (https://www.oppodigital.com/headphones-pm-3/).

Designs of transducers with closed magnetic systems, preferably ring-shaped, and corresponding round membranes, comprising voice coils with spiral-shaped conductors, are more efficient compared to transductors with zigzag (meander-shaped) voice coils. Better efficiency is achieved by the round shape of membranes and voice coils because no part of conductors extends beyond the magnetic field of permanent magnets which are not involved in the process of electroacoustic transduction.

Thus, the electroacoustic transducer for headphones according to Application GB 1418360, published on Dec. 17, 1975, which can be used for headphones, is taken as a prototype. The prototype transducer comprises a dielectric vibration membrane with a flat voice coil, a flat magnetic system comprising magnetized closed magnets axially spaced in concentric relationship, mounted on the both sides of the vibration membrane so that the magnetic field can interact with the voice coil. A set of coaxially placed magnetic rings with alternation of polarity is used as a magnetic system. The voice coil is configured to form a spiral and is located opposite the poles of the magnetic system.

The disadvantage of this solution is that the shape of the membrane used therein is not adapted to that of the human ear auricle and is irrational in terms of the active membrane area determined by the area of voice coil conductors and magnetic system elements involved in the transduction. Such transducer shape will result in the irrational shape of the inner cavity of the earpiece that covers the human ear auricle and to an unreasonable increase in the dimensions of headphones.

The object of the present invention is to improve the quality of electroacoustic transduction by expanding the range of reproducible frequencies and increasing the efficiency of the transducer and, at the same time, by minimizing the inner volume of the earpiece of the headphones, with which the disclosed transducer is used, and the dimensions of the transducer, and by using the shape of the membrane adapted as much as possible to that of the human ear, by achieving the distribution of zones of interaction between magnets and voice coils within the ear so that direct and reflected sound waves will form the sound field which allows a listener to hear sound images close to real ones and by forming a sound field to increase the proportion of direct high-frequency signal getting directly the ear canal.

The said object is achieved in that in the electroacoustic transducer for headphones, known in the art, comprising a dielectric vibration membrane with a flat voice coil, a flat magnetic system comprising magnetized closed magnets axially spaced in concentric relationship, mounted on at least one side of the vibration membrane configured so that the magnetic field can interact with the voice coil, according to the invention, the magnetic system further comprises at least two arc-shaped magnets located above the closed magnets and curved in the direction opposite to the closed magnets, and the voice coil comprises at least one part, which is located in the area of closed magnets and follows the shape of closed magnets, and the second part, which is located in the area of arc-shaped magnets and is meander-shaped.

According to one preferred embodiment of the invention, the pole area of closed magnets should be 55-60 percent of the pole area of arc-shaped magnets.

According to another preferred embodiment of the invention, the membrane may be oval.

According to yet another preferred embodiment of the invention, the membrane may have a shape of an irregular oval tapered to the bottom.

According to yet another preferred embodiment of the invention, a part of the membrane with the voice coil located in the area of closed magnets may be configured so that maximum sound pressure can be generated and said part is located in the area of the entrance to the human ear canal.

According to yet another preferred embodiment of the invention, ring-shaped magnets may be used as closed magnets spaced in concentric relationship.

According to yet another preferred embodiment of the invention, the part of the voice coil, which is located in the area of closed magnets, can be spiral.

According to yet another preferred embodiment of the invention, arc-shaped magnets can have the shape of annular sectors placed concentrically to closed ring-shaped magnets.

According to yet another preferred embodiment of the invention, closed magnets and arc-shaped magnets can be located on the both sides of the vibration membrane to form the frontal part and the back part of the magnetic system.

According to yet another preferred embodiment of the invention, the frontal part of the magnetic system may be acoustically transparent.

According to yet another preferred embodiment of the invention, the vibration membrane is corrugated.

According to yet another preferred embodiment of the invention, the ratio of the total area of the poles of the magnetic system to the active area of the vibration membrane is at least 83%.

The technical result achieved with the use of the invention consists in a more rational distribution of sound pressure in the auricular area and achieving a more uniform amplitude-frequency profile while maintaining high energy efficiency of the transducer and an optimal distribution of the sound intensity along the sound wave front at frequencies above 10 KHz, when the length of sound waves is commensurate with the size of the membrane and elements of the headphone design due to the corresponding ratio of the direct and reflected sound waves in the zone of an ear canal. The use of the invention results in a significant improvement in the subjective focusing of spatial sound images at high frequencies.

LIST OF DRAWINGS, DIAGRAMS AND TABLES

FIG. 1*a-d* shows various shapes of internal cavities of earpieces covering the human ear auricle and their minimal areas S.

FIG. 2*a-c* shows options of how various shapes of the inner cavity of the earpiece can be filled with magnetic systems having approximately the same area of magnets S.

Figure 1A:
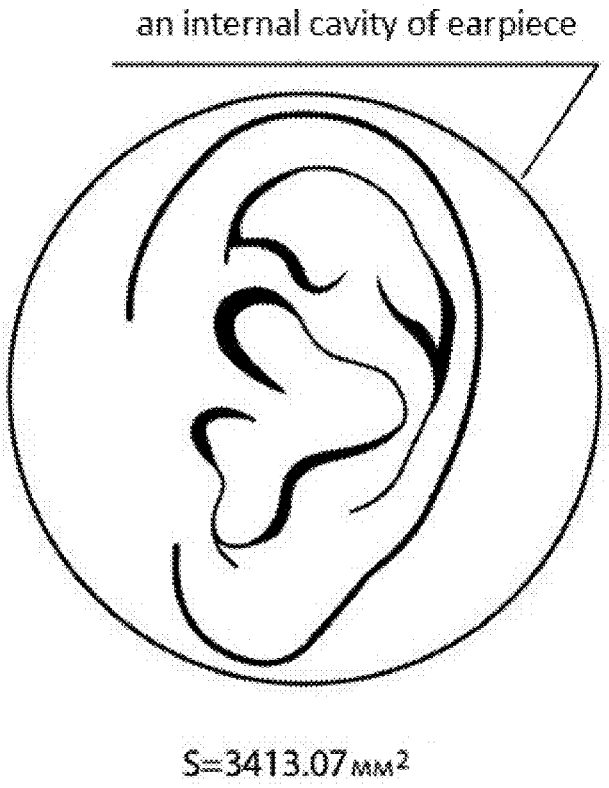
Figure 1B:
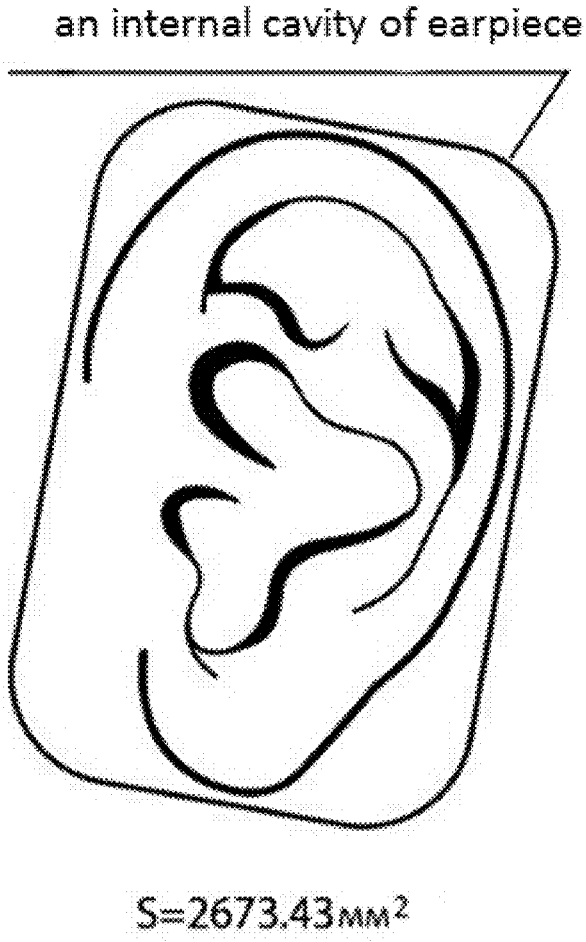
Figure 1C:
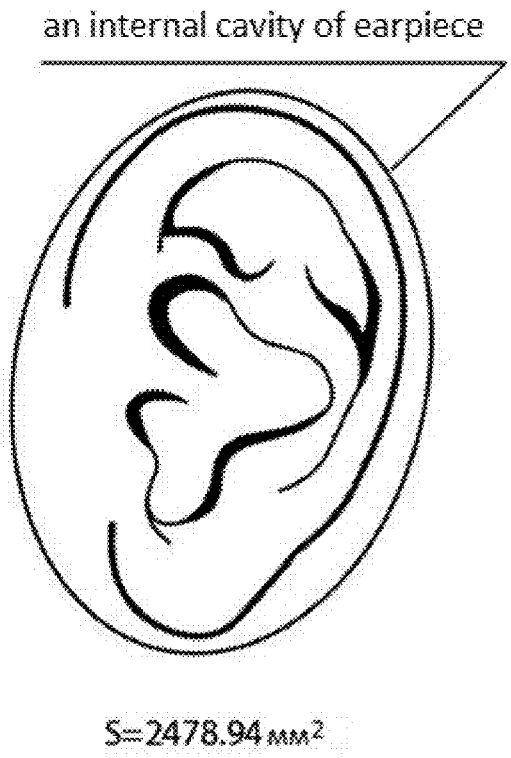
Figure 1D:
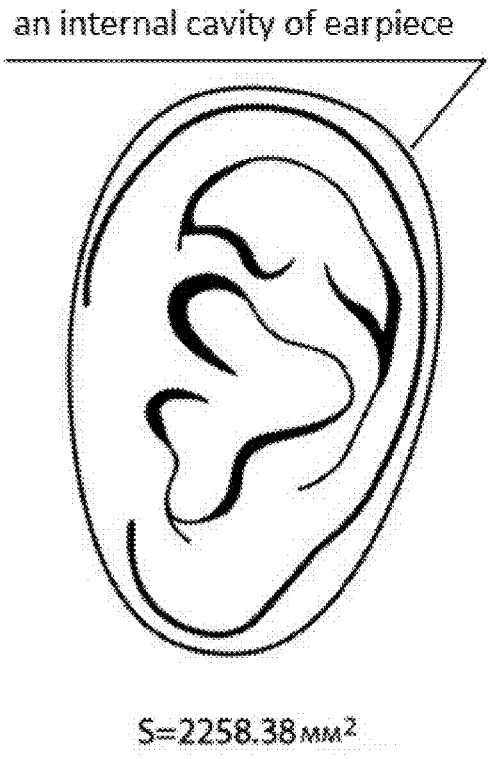

FIG. 12 presents correlations of sound pressure levels at control frequencies depending on how parts of the combined transductor magnetic system correlate to each other.

FIGS. 13-16 demonstrate the distribution of the sound field for the combined transducer magnetic system at frequencies 10 (Table 2), 20 (Table 3), 30 (Table 4), and 40 (Table 5) kHz by ear auricle zone.

BACKGROUND OF THE INVENTION

As noted above, transducers with round magnetic systems and spiral-shaped voice coils are more efficient compared to transductors with zigzag (meander-shaped) voice coils because no part of conductors extends beyond the magnetic field of permanent magnets which are not involved in the process of electroacoustic transduction.

It is also known that the improvement of the quality of electroacoustic transducers depends on the increase of the membrane area S. The more is the membrane surface S, the higher is the acoustic flexibility of the membrane $C_a=C\times S^2$ for efficient operation in the low-frequency range and the lower is the acoustic mass of the membrane $m_a=m/S^2$ for efficient operation in the high-frequency range. Further, the improvement of the quality of electroacoustic transducers is achieved using a magnetic system that provides uniform excitation of the entire membrane area. To fulfill these conditions, the ring-shaped membrane is irrational, and the transducer which uses such membrane is cumbersome. Thus, an important condition for a high-quality and efficient transducer is not the total area of the membrane, but the active area of the membrane. The active area of the membrane is understood as the area of conductors of the flat voice coil located in the working magnetic gaps of the magnetic system, since the areas of the membrane, free from voice coil conductors, will vary in a certain frequency range not in the in-phase manner which increases the uniformity of frequency response of sound pressure of the transducer. Thus, the shape of the magnetic system of the electroacoustic transducer should correspond, as a minimum condition, to the shape of the inner cavity of the earpiece covering the human ear auricle.

FIG. 1 *a-d* shows various shapes of internal cavities of earpieces covering the human ear auricle and their minimal area S: FIG. 1*a* shows a circular shape, FIG. 1*b*—a rectangular shape, FIG. 1*b*—an elliptical shape, FIG. 1*d*—an oval (egg) shape, more specifically, the shape of an irregular oval tapered towards the bottom. According to FIGS. 1*a*-1*d*, the shapes of internal cavities of the earpiece of FIG. 1*c* and FIG. 1*d*, and the corresponding common shapes of outlets of the transducer magnetic system have a minimal area, which is however sufficient to provide a rational distribution of sound pressure in the area of the ear auricle. Thus, such common shapes of outlets of the transductor magnetic system allow the inventors to minimize the internal volume of the earpiece and the dimensions of the electroacoustic transductor.

Figure 2A:
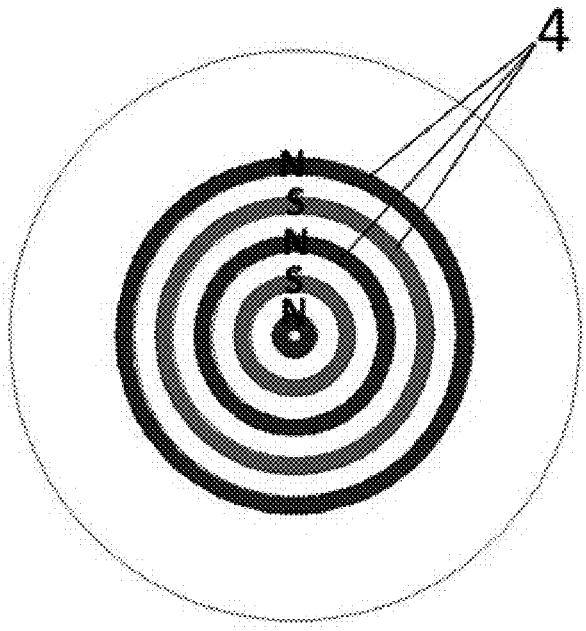
Figure 2B:
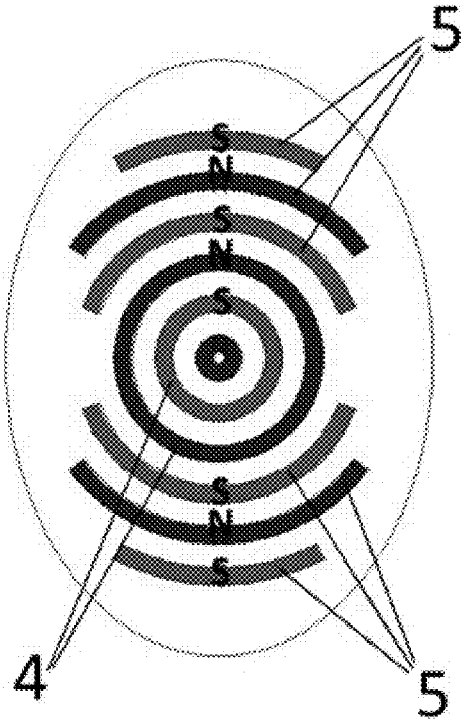
Figure 2C:
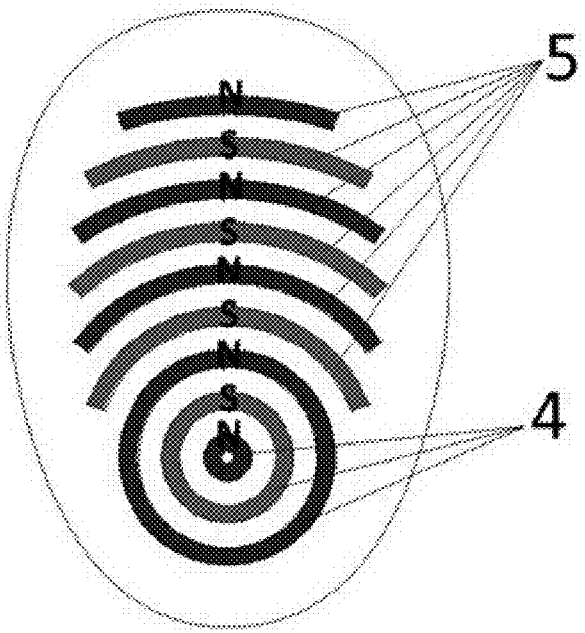

The inventors have also run a series of experiments to study options of how various shapes of the inner cavity of the earpiece can be filled with magnetic systems having approximately the same area of magnets S to choose the optimal configuration of the magnetic system. The magnetic system configurations so studied are illustrated in FIG. 2*a-c*. The study used earpieces with the same height of the cavity determined by the size of the human ear auricle. FIGS. 2*a*-2*c* show magnetic systems with axially magnetized magnets when the magnetization vector passes through the thickness of the magnet, i.e. the upper part of the magnet is one pole and the lower part is the opposite pole. In this case, axially magnetized magnets have polarity of alternating poles (from center to periphery). Therefore, in FIGS. 2*a*-2*c*, north poles are shown with a darker shade, and the south poles are shown with a lighter shade.

An embodiment of a magnetic system according to FIG. 2*c* comprising an oval membrane or a membrane having the shape of an irregular oval tapered to the bottom and a magnetic system that is a combination of closed magnets (ring magnets, as shown in FIG. 2*c*, or oval magnets or rectangular magnets) and at least two arc-shaped magnets located above the closed magnets and curved in the direction opposite to the closed magnets, is adapted as much as possible to the shape of the human ear and allows to achieve a good uniformity of the magnetic field and to simplify the arrangement of electrical leads of the voice coil as there is no need in the central fixation of the membrane.

When conducting experiments to choose the optimal shape of the membrane, the inventors also tested magnetic systems with different ratios of the pole area of one part of the magnetic system (poles of closed magnets) to the area of the other part of the magnetic system (poles of arc-shaped magnets) in terms of achieving a balanced frequency response of the transductor. The results of the experiments are given in Table 1. Table 1 presents ratios of sound pressure levels at control frequencies indicating the formation of frequency response (FR) close to the target FR. Target FR is generated by Harman using an artificial head and is available at https://www.innerfidelity.com/content/headphone-measurements-explained-frequency-response-part-two. Approximation to the target FR is required to achieve balanced (tone-correct) sounding of headphones with subjective listening. According to Table 1, the optimal pole area of closed magnets is within 55-60 percent of the pole area of arc-shaped magnets. Thus, the balanced FR of the transductor can be achieved by combining closed (ring-shaped) magnets in the area of the human ear canal and arc-shaped magnets located above the closed magnets and the respective topology of the voice coil as well as by applying an optimal ratio of the pole area of the closed magnets to the pole area of the arc-shaped magnets within 55-60 percent.

The invention claimed is illustrated by the following exemplary embodiment of the transductor and is accompanied by the drawings described above. Particular embodiments and figurative materials that illustrate the invention claimed are in no way intended to limit other embodiments of the transducer according to the invention but to explain the essence of the invention.

The electroacoustic transducer for headphones comprises a dielectric vibration membrane (1) with a flat voice coil (2) fixed thereon and a flat magnetic system (3).

Figure 3:
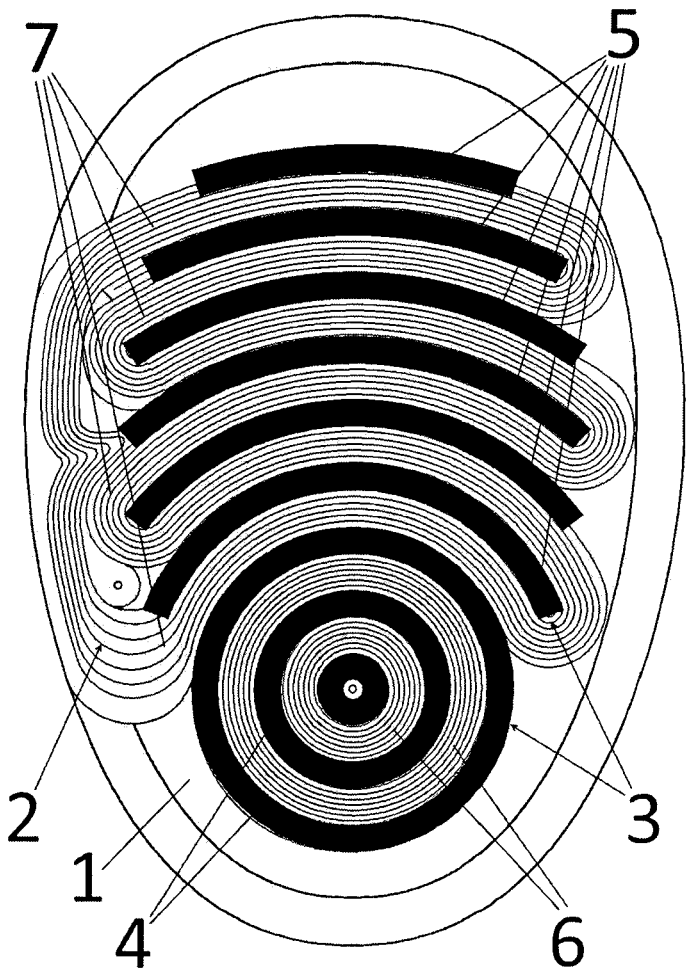
FIG. 3 is a profile view of the magnetic system and the voice coil of the transductor.

The vibration membrane (1) is preferably shaped to be oval or has a shape of an irregular oval tapered to the bottom (FIG. 3). The vibration membrane (1) can be corrugated.

The magnetic system (3) comprises magnetized axially spaced in concentric relationship closed magnets (4) and at least two arc-shaped magnets (5) located above the closed magnets (4) and curved in the direction opposite to the closed magnets (4). Ring-shaped magnets can be used as closed magnets (4) spaced in concentric relationship. In this case, arc-shaped magnets (5) can have the shape of annular sectors placed concentrically to closed ring-shaped magnets (4). Closed magnets (4) and arc-shaped magnets (5) are mounted so that the magnetic field can interact with a voice coil (2). The pole area of the closed magnets (4) is preferably 55-60% of the pole area of the arc-shaped magnets (5), e.g., the pole area of the closed magnets (4) can be 58% of that of the arc-shaped magnets (5). The ratio of the total pole area of the magnetic system (3), i.e. the total pole area of closed ring-shaped magnets (4) and the pole area of the arc-shaped magnets (5), to the active area of the vibration membrane (1) is not less than 83%, e.g., 85%.

Figure 8:
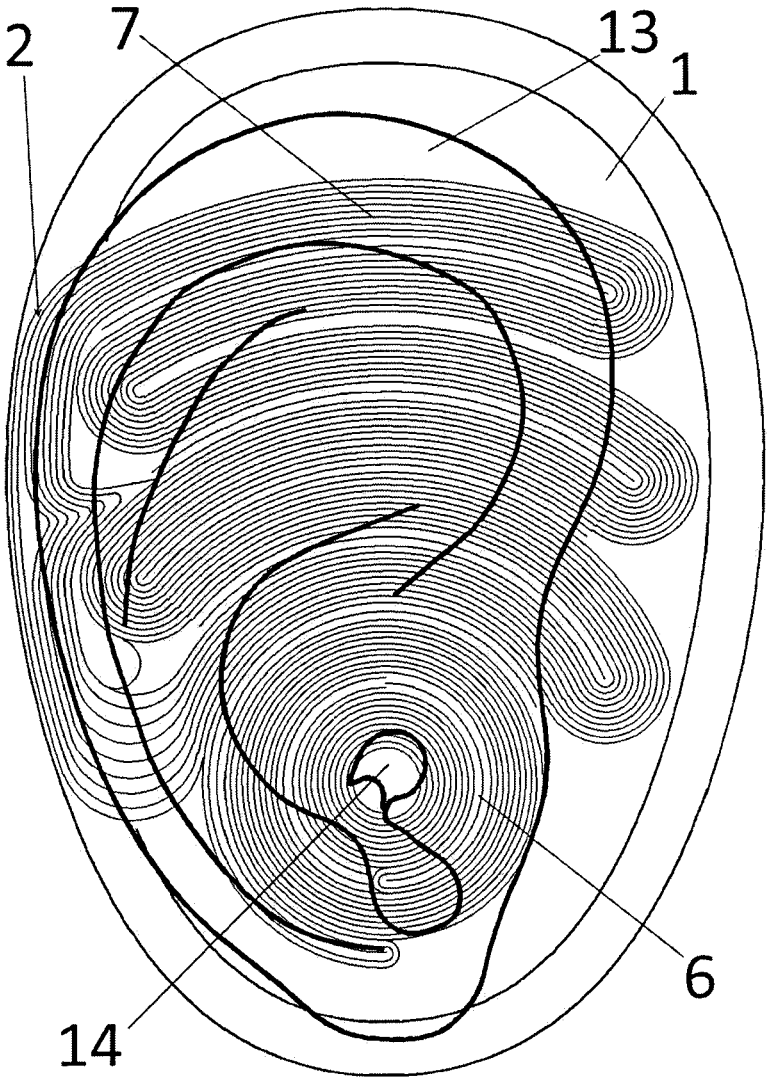
FIG. 8 is a projection of the transducer voice coil to the human outer ear.

The voice coil (2) preferably consists of two parts: the part (6) and the part (7), which are interconnected. The part (6) is located in the area of closed magnets (4) and follows the shape of the closed magnets (4). In particular, when closed ring-shaped magnets are used (4), the part (6) of the voice coil (2) is shaped to be spiral. The part (7) of the voice coil (2) is located in the area of the arc-shaped magnets (5) and is meander-shaped (zigzag). The part of the membrane of the voice coil located in the area of closed magnets (4)—the part (6)—is configured to cause maximum sound pressure and is located in the area of the entrance to the ear canal of the human ear auricle (FIG. 8). Maximum sound pressure can be achieved by increasing the amount of direct signal from the membrane (1).

Figure 4:
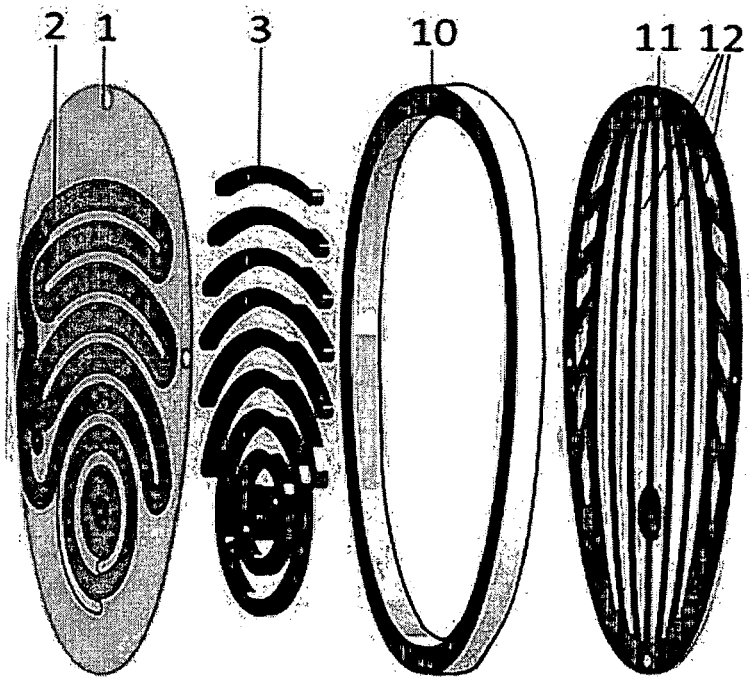
FIG. 4 is a general view of elements of the transductor with a one-sided (asymmetric) magnetic system.
Figure 5:
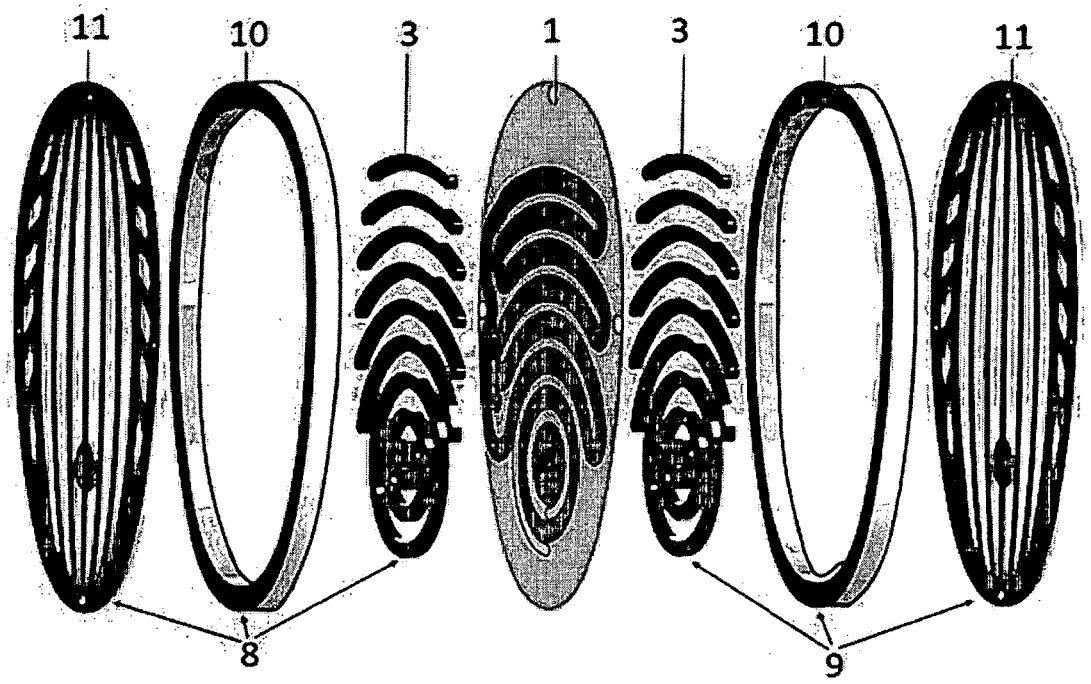
FIG. 5 is a general view of elements of the transductor with a two-sided (symmetric) magnetic system.

The magnetic system (3) can be made as a one-side planar magnetic system—an asymmetrical structure (FIG. 4)—when the closed magnets (4) and the arc-shaped magnets (5) are mounted on one side of the vibration membrane (1). The invention also provides for the embodiment of a magnetic system (3) as a symmetrical (two-sided) planar magnetic system (FIG. 5), when closed magnets (4) and arc-shaped magnets (5) are located on the both sides of the vibration membrane (1) to form the frontal part (8) and the back part (9) of the magnetic system (3). In this case, the frontal part (8) of the magnetic system (3) should be acoustically transparent.

The membrane (1) with the voice coil (2) and the magnetic system (3), either one- or two-sided, is mounted on the transducer with the help of a frame (10) closed from the outside with a grid (11) with sound-transmitting openings (12), which provide acoustic transparency of the magnetic system (3). The frame (10) and the grid (11) have a shape that follows that of the membrane (1).

Figure 6:
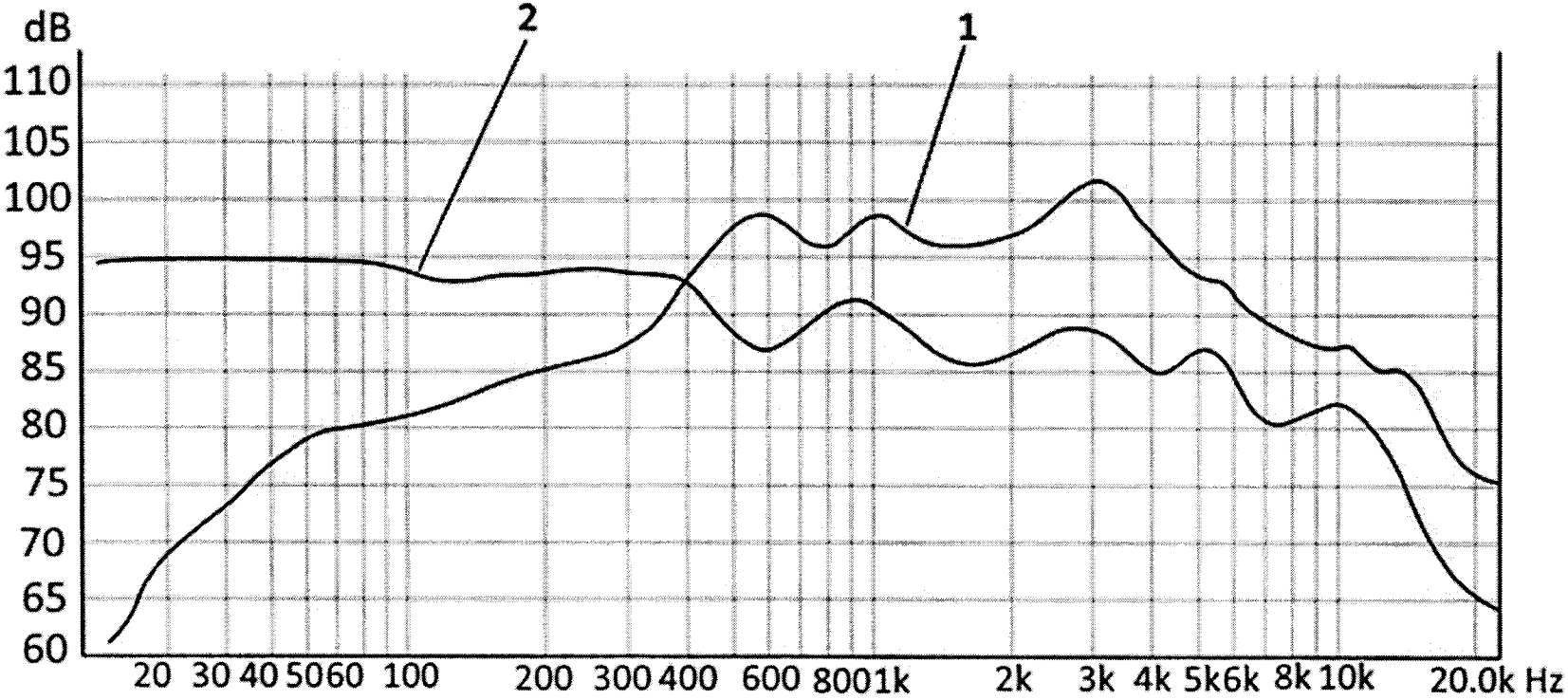
FIG. 6 shows frequency response of sound pressure of membrane sections with a spiral-shaped coil (curve 1) and a meander-shaped coil (curve 2).

The measurement of electroacoustic parameters of various parts of the transductor shows that a more efficient electroacoustic transduction in mid- and high-frequency ranges is achieved at the site of the membrane (1) with the voice coil (2) located in the area of closed magnets (4), i.e. the spiral part (6), rather than at the site of membrane (1) whereon the meander-shaped (zigzag) part (7) of the voice coil (2) is fixed. Said parameters are confirmed by frequency response (FR) of sound pressure at the site of the membrane (1) with the spiral part (6) of the voice coil (2), curve 1 in FIG. 6, and site of the membrane (1) with the meander-shaped part (7) of the voice coil (2), curve 2 in FIG. 6

Figure 7:
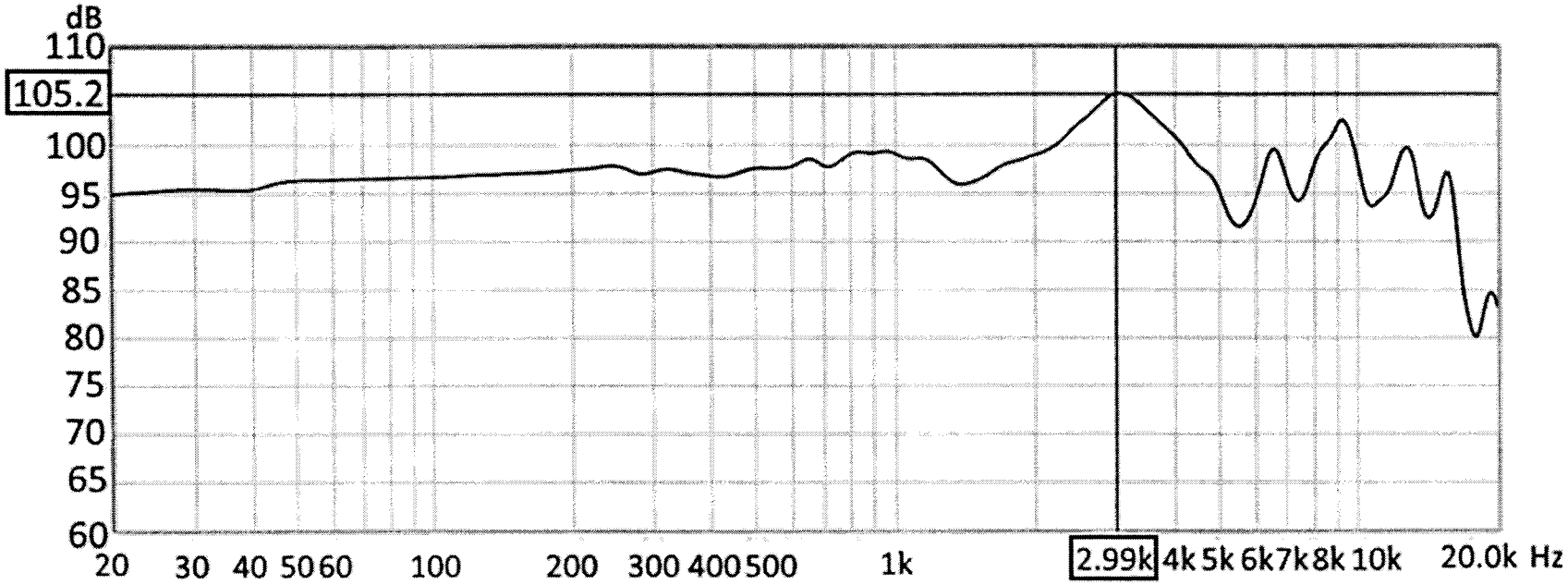
FIG. 7 shows overall frequency response of sound pressure of the transductor.

By adjusting the sensitivity ratio of both sites of the membrane (1) of the transductor, one can obtain a balanced frequency response of sound pressure of the claimed transducer (FIG. 7).

The combination of different topologies of the voice coil (the spiral topology of the voice coil in the area of the entrance to the human ear canal and the meander-shaped topology of the voice coil located above the spiral) also allows us to achieve the correct distribution of the sound intensity along the sound wave front at high frequencies, which "irradiates" the ear auricle (13) and the ear canal (14), FIG. 8. At frequencies above 10 kHz, where the sound wave length (3.4 cm) is smaller than the size of the inner cavity of the earpiece (8.0 cm×5.0 cm), the sound field becomes diffuse with a certain ratio of the direct sound wave (15) and the reflected sound wave (16) falling directly into the ear canal (14).

With uniform "irradiation" of the ear with a high-frequency signal up to 30% of the direct sound wave (15) falls into the ear canal (14). The reflected sound wave (16) enters the ear canal (14) with different time delays, thereby compromising the focus of spatial sound images.

The location of the part (6) of the voice coil (2) coaxially with the entrance to the ear canal (14), as shown in FIG. 8, allows us to increase the proportion of sound energy emitted directly into the ear canal (14).

Thus, in addition to the formation of frequency response of sound pressure of the transductor at high frequencies, subjective focusing of spatial sound images improves.

It is also possible to achieve the necessary sound intensity distribution along the sound wave front using only the topology of the meander-shaped voice coil and selecting the desired area of the voice coil, where the magnetic induction in the working gaps of the planar magnetic system should be increased. However, using a combined transductor comprising a voice coil with two parts—the spiral part (6) and the meander-shaped (zigzag) part (7) will be a more optimal solution. Such transductor is more efficient, since 100% of conductors of its voice coil are in the working magnetic gaps, unlike the transductor, which only uses a meander-shaped voice coil or a spiral voice coil.

Figure 10:
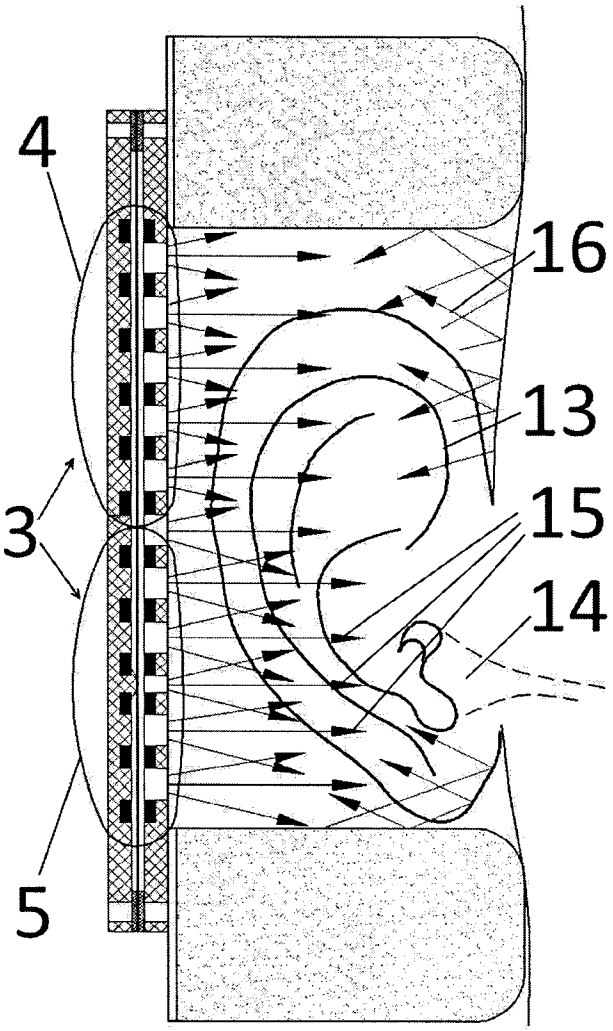
FIG. 10 is a cross-sectional view of the electroacoustic transducer according to the present invention.
Figure 9:
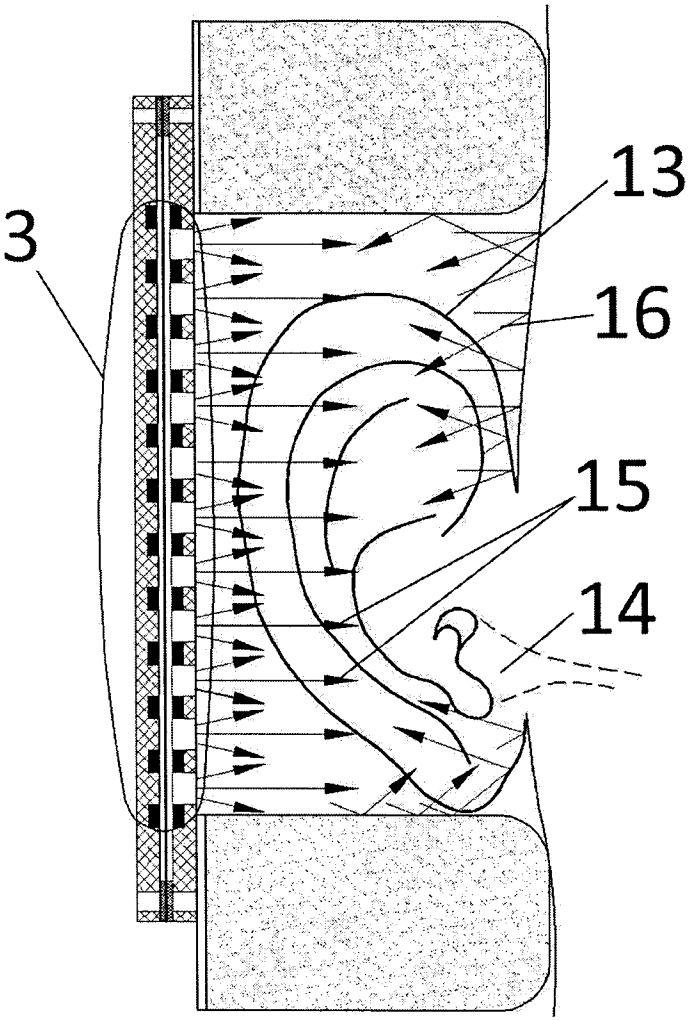
FIG. 9 is a cross-sectional view of the electroacoustic transducer with the meander-shaped voice coil.
Figure 11:
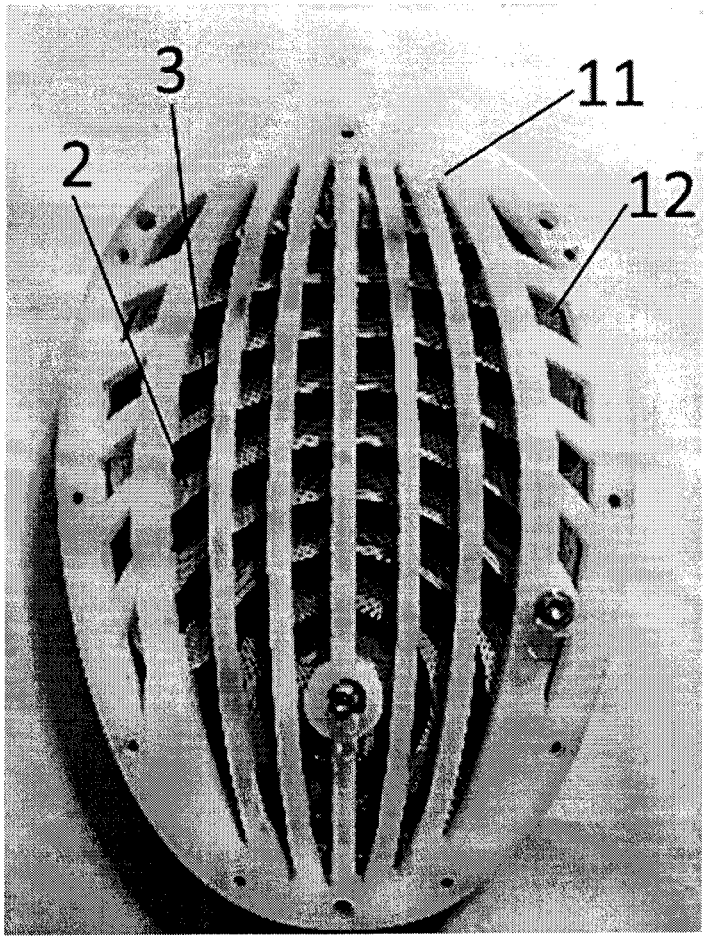
FIG. 11 is a photo with a profile view of the transductor according to the invention.
Figure 13:
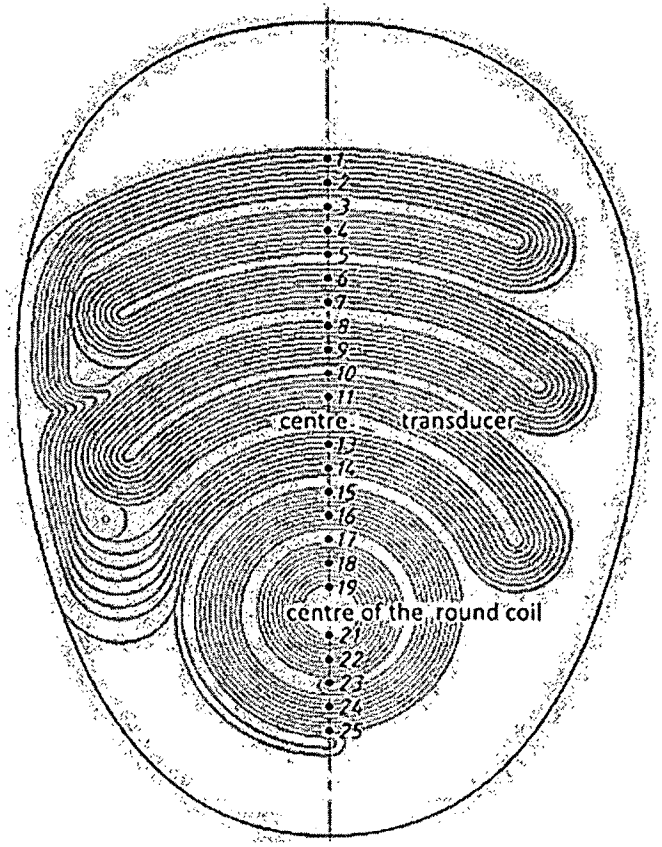
Figure 14:
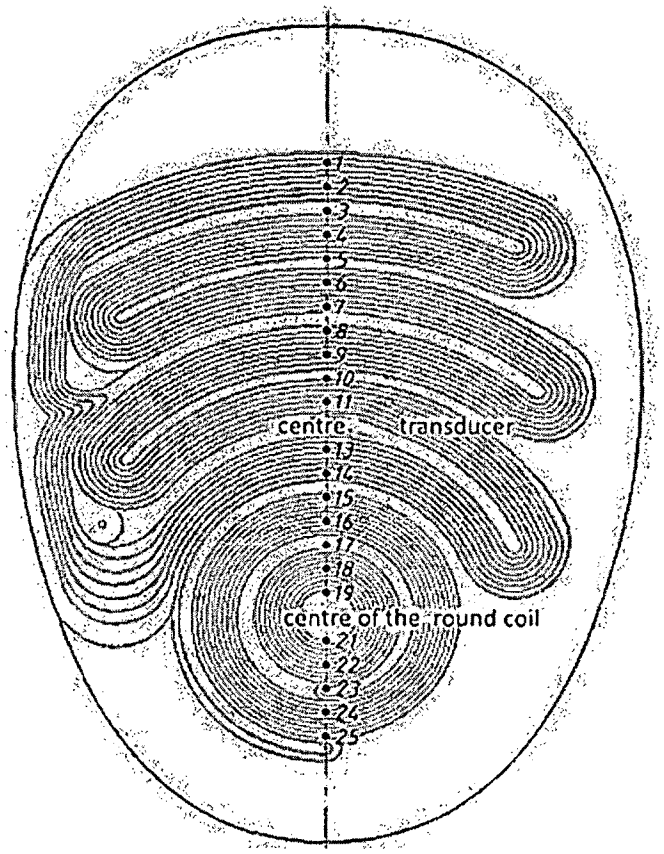
Figure 15:
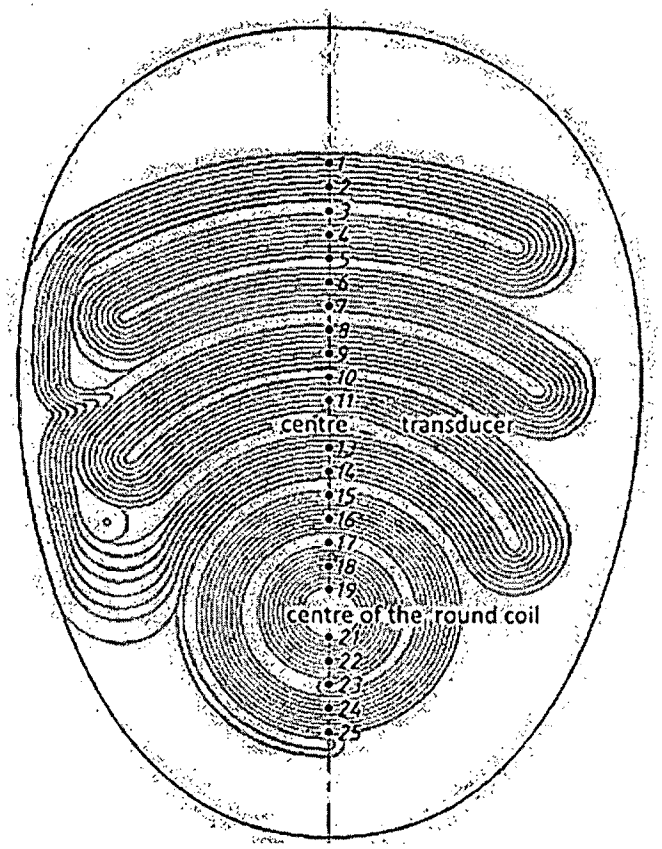
Figure 16:
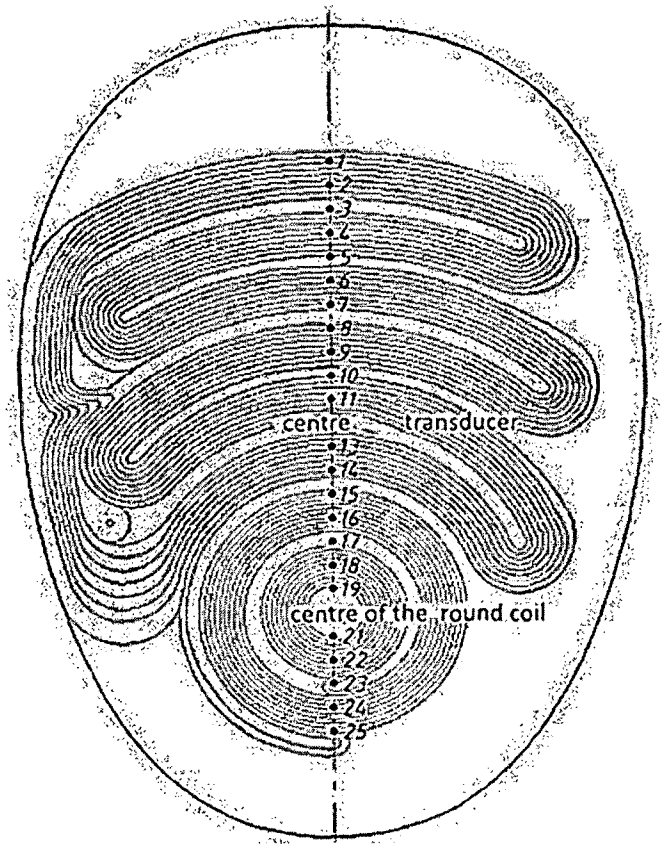

FIGS. 9 and 10, respectively, illustrate the claimed transducer and the transducer with a meander-shaped voice coil, where the direction of the direct sound wave (15) and the reflected sound wave (16) is shown by zone of the ear auricle (13) with vector arrows. The length of the arrows in FIGS. 9 and 10 refers to the sound level. Comparison of sound pressure parameters by zone in FIG. 9 and FIG. 10 indicates that the proportion of the direct sound wave (15) in the claimed transductor with the combined coil is larger (FIG. X) than that in electroacoustic transductors with a meander-shaped voice coils.

Tables 2-5 show the distribution of the sound field for the combined magnetic system of the transductor at frequencies 10, 20, 30, and 40 kHz by zone of the ear auricle (13), which are indicated as sound pressure measurement points (from point 1 to point 25) that denote the distance from the transductor membrane to the ear auricle (13). Tables 2-5 demonstrate that the maximum sound pressure levels for the claimed transducer (highlighted in gray) are within the region of the membrane with a maximum sound pressure close to the entrance to the ear canal, indicating an optimal distribution of sound pressure in the area of the ear auricle and achieving a more uniform frequency response while maintaining high energy efficiency of the transductor as well as optimal sound intensity distribution along the sound wave front at frequencies above 10 KHz.

Thus, the use of the combined magnetic system comprising closed, preferably ring-shaped, magnets located in the area of the ear canal of the human ear auricle and arc-shaped magnets located above the closed magnets and curved in the direction opposite to the closed magnets, with a certain ratio of pole areas, as well as the use of the respective topology of the voice coil with the part that follows the shape of closed magnets and the meander-shaped part located in the area of arc-shaped magnets allows to achieve improvement in qualities of electroacoustic transduction by expanding the range of reproducible frequencies and increasing the efficiency of the transducer while minimizing the internal volume of the earpieces of headphones.

The invention claimed is:

1. An electroacoustic transducer for headphones comprising a dielectric membrane with a flat voice coil, a flat magnetic system comprising magnetized closed magnets axially spaced in concentric relationship, mounted on at least one side of the membrane configured so that a magnetic field of the magnetic system can interact with the voice coil, wherein the magnetic system further comprises at least two arc-shaped magnets located above the closed magnets and curved in a direction opposite to the closed magnets, and wherein the voice coil comprises at least one part, which is located in an area of the closed magnets and follows a shape of the closed magnets, and a second part, which is located in an area of the arc-shaped magnets and is meander-shaped.

2. The electroacoustic transducer of claim 1 wherein a pole area of the closed magnets should be 55-60 percent of a pole area of the arc-shaped magnets.

3. The electroacoustic transducer of claim 1 wherein the membrane is oval.

4. The electroacoustic transducer of claim 1 wherein the membrane has a shape of an irregular oval tapered to its bottom.

5. The electroacoustic transducer of claim 1 wherein a part of the membrane with the voice coil located in the area of the closed magnets may be configured so that maximum sound pressure can be generated and said part is located in an area of an entrance to a human ear canal.

6. The electroacoustic transducer of claim 1 wherein ring-shaped magnets are used as the closed magnets spaced in concentric relationship.

7. The electroacoustic transducer of claim 6 wherein the part of the voice coil, which is located in the area of closed magnets, is spiral.

8. The electroacoustic transducer of claim 6 wherein the arc-shaped magnets have the shape of annular sectors placed concentrically to closed ring-shaped magnets.

9. The electroacoustic transducer of claim 1 wherein closed magnets and arc-shaped magnets are located on both sides of the membrane to form a front and a rear of the magnetic system.

10. The electroacoustic transducer of claim 1 wherein the membrane is corrugated.

* * * * *